US008690262B2

(12) United States Patent
Ebner et al.

(10) Patent No.: US 8,690,262 B2
(45) Date of Patent: Apr. 8, 2014

(54) HEADING MACHINE HAVING CUTTING UNIT MADE OF DISC TOOLS

(75) Inventors: Bernhard Ebner, Knittelfeld (AT); Peter Kogler, Knittelfeld (AT)

(73) Assignee: Sandvik Mining and Construction G.m.b.H., Vienna (AT)

( * ) Notice: Subject to any disclaimer, the term of this patent is extended or adjusted under 35 U.S.C. 154(b) by 190 days.

(21) Appl. No.: 12/735,675

(22) PCT Filed: Jan. 16, 2009

(86) PCT No.: PCT/AT2009/000013

§ 371 (c)(1),
(2), (4) Date: Aug. 6, 2010

(87) PCT Pub. No.: WO2009/100469

PCT Pub. Date: Aug. 20, 2009

(65) Prior Publication Data

US 2010/0314931 A1 Dec. 16, 2010

(30) Foreign Application Priority Data

Feb. 15, 2008 (AT) ..... A 250/2008
Oct. 30, 2008 (AT) ..... A 1696/2008

(51) Int. Cl.
*E21C 25/16* (2006.01)

(52) U.S. Cl.
USPC ..... 299/75

(58) Field of Classification Search
USPC ..... 299/31, 64, 73–77, 78, 33; 405/288
See application file for complete search history.

(56) References Cited

U.S. PATENT DOCUMENTS

| | | | | | |
|---|---|---|---|---|---|
| 2,619,338 | A | * | 11/1952 | Lindgren | 299/67 |
| 3,663,054 | A | | 5/1972 | Dubois | |
| 3,860,292 | A | * | 1/1975 | Bechem | 299/110 |
| 4,005,905 | A | * | 2/1977 | Dubois | 299/31 |
| 4,035,024 | A | * | 7/1977 | Fink | 299/31 |
| 4,133,582 | A | * | 1/1979 | Kogelmann | 299/64 |
| 4,486,050 | A | * | 12/1984 | Snyder | 299/18 |
| 4,548,442 | A | * | 10/1985 | Sugden et al. | 299/10 |
| 4,645,266 | A | * | 2/1987 | Paurat et al. | 299/64 |
| 4,664,449 | A | * | 5/1987 | Barnthaler et al. | 299/74 |
| 4,688,855 | A | * | 8/1987 | Barnthaler et al. | 299/75 |
| 4,770,469 | A | | 9/1988 | Schellenberg et al. | |
| 4,865,390 | A | * | 9/1989 | Shrader et al. | 299/11 |
| 5,192,115 | A | * | 3/1993 | Hartman et al. | 299/31 |
| 5,192,116 | A | | 3/1993 | Turner et al. | |
| 5,333,936 | A | | 8/1994 | Zitz | |
| 7,438,365 | B2 | * | 10/2008 | Kaiser et al. | 299/74 |
| 2003/0230925 | A1 | * | 12/2003 | Oishi | 299/87.1 |

FOREIGN PATENT DOCUMENTS

| | | | |
|---|---|---|---|
| EP | 0 004 832 | B1 | 4/1982 |
| EP | 0 221 886 | A1 | 5/1987 |
| EP | 1 344 894 | A1 | 9/2003 |
| FR | 2 839 742 | A1 | 11/2003 |

* cited by examiner

*Primary Examiner* — Sunil Singh
(74) *Attorney, Agent, or Firm* — Taft Stettinius & Hollister LLP

(57) ABSTRACT

In a heading machine (1, 24) with at least one cutting unit with a rotatably mounted tool holder (10, 39) with disc tools (11, 12, 40, 41), which tool holder is connected in a pivotable manner to the machine frame, the heading machine (1, 24) has a running gear, in particular a crawler track (2), the tool holder (10, 39) is mounted rotatably on an arm (6, 26), which can be pivoted in the vertical direction and the rotational axis (9) of the tool holder (10, 39) runs transversely with respect to the longitudinal axis of the arm (6, 26).

19 Claims, 7 Drawing Sheets

HEADING MACHINE HAVING CUTTING UNIT MADE OF DISC TOOLS

Figure 1:
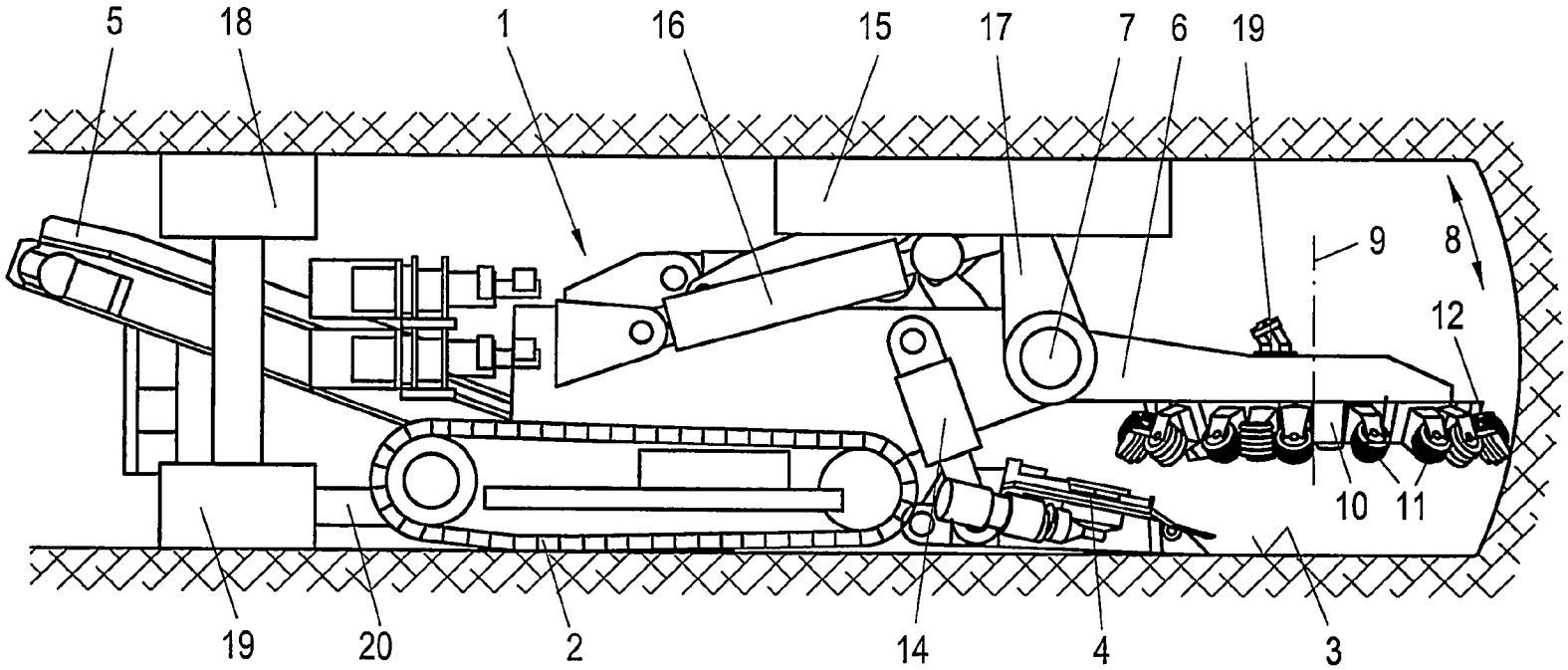

The invention relates to a heading machine with at least one cutting unit with a rotatably mounted tool holder with disc tools, which tool holder is connected in a pivotable manner to the machine frame.

Heading machines with disc tools have become known in various configurations. In addition to the use of disc tools for full-thickness cutting machines, as are used for example in shield heading machines and with, which a tunnel with an essentially circular cross section or a circular cross-sectional area can be cut, configurations have become known, in which the disc tools are pivoted over the heading face about an axis, which is different from the rotational axis of the tool holder.

EP 004 832 B1 discloses and describes a machine, in which the disc tools are arranged on a convex tool holder and while operating are in contact with the heading face to be cut during the whole revolution of the tool holder. The rotating tool holder with the disc tools in full-thickness operation can be pivoted over the heading face in the vertical direction. The height of the road, which can be achieved in this manner is limited by the design of the tool holder and the arrangement of the disc tools in order to ensure the continuous contact of the tools with the material to be removed during a pivoting movement of this type. This known configuration must absorb extremely high cutting forces as reaction forces and therefore requires a machine, which is braced stationary between roof and floor and can therefore not be configured as an autonomously moveable machine. A similar situation applies for U.S. Pat. No. 3,663,054, in which a machine is in turn likewise described, which is braced between roof and floor by means of a plurality of stays and has two cutting units, which each contain a rotatably mounted tool holder with disc tools. The pivoting movement of this cutting unit takes place about an essentially perpendicular or vertical axis, which extends from the roof to the floor essentially parallel to the heading face, with the tools in this case being arranged in an undercutting manner in order to increase the proportion of broken material with respect to the proportion of cut material, which seems advantageous with certain states of rock.

In practice, it has been found that the advancing performance during advance heading, with which the undercutting principle is used is limited even with hard rock machines. Furthermore, the previously known use of pivotable cutting tools along with disc tools allows no essential change in the height of the profile to be cut without complex conversion work.

The invention hence aims at improving a heading machine of the initially mentioned kind to such an extent that it allows a road course to be obtained simply, which deviates from a road that runs in a straight line, and can also be used for different profile heights without complex conversion work. At the same time the invention is aimed at significantly increasing the advancing performance compared to known devices.

In order to achieve this object, the heading machine according to the invention essentially consists, starting from the configuration mentioned in the introduction, in that the heading machine has a running gear, in particular a crawler track, that the tool holder is rotatably mounted on an arm, which can be pivoted in the vertical direction, and that the rotational axis of the tool holder runs transversely with respect to the longitudinal axis of the arm, with it being possible to bring the disc tools into contact with the material to be removed over part of the circumference of the tool holder. The mobility and thus the ability of the machine to negotiate curves is ensured by the dedicated running gear, with the fact that the tool holder is now mounted on an arm, which can be pivoted in the vertical direction meaning that merely by varying the dimension of the tool holder different road widths and owing to the relatively large pivoting angle also correspondingly different heights can be broken or cut with one and the same arm. The fact that the rotational axis of the tool holder now runs transversely with respect to the longitudinal axis of the arm, with it being possible to bring the disc tools into contact with the material to be removed only over part of the circumference of the tool holder, means that it is now possible for the disc tools to be arranged on the circumference of the tool holder according to the requirements in each case in such a manner that they can be operated in different working areas over the entire height of the heading face in each case with optimum advancing performance, with this configuration meaning above all that the essential advantage can be achieved that the penetration depth can be substantially increased compared to known cutting tools, which operate in an undercutting manner, which in turn substantially increases the advancing performance. Depending on the required width of the road profile, tool holders with different diameters can be fastened to the arm, with the envelope defining the width of the profile to be cut corresponding to the diameter of the tool holder with the discs fastened to its circumference. Penetration can be carried out by moving the heading machine or the crawler track, with it being possible for this function to use discs with an orientation, which is different from the orientation of the disc tools for the main cutting direction, which are likewise arranged on the circumference.

Advantageously the configuration according to the invention is such that the tool holder has a disc-shaped configuration, with it being possible to realise the advantages explained at the start particularly simply by the rotational axis of the tool holder forming an angle of 45° to 135° with the longitudinal axis of the arm and preferably running approximately normally with respect to the longitudinal axis of the arm.

In order to be able to take into account different operating modes of the heading machine optimally, the configuration is advantageously such that the individual discs or disc bundles on the circumference of the tool holder are arranged with a different orientation or cutting direction from other discs. In this manner, individual disc tools for penetrating the roof and other disc tools for knocking off to the floor can be orientated in an optimised manner. The individual disc tools on the circumference are advantageously arranged in such a manner that the plurality of the discs or disc bundles are arranged inclined in the direction to the floor. These cutting tools are thus particularly suitable for the main cutting process from the roof to the floor. Other discs, whose cutting direction is oriented towards the roof and/or in the advancing direction, can advantageously be used for cutting the penetration at the roof.

In order to ensure the optimum defined penetration in each case, the configuration is advantageously such that the movable machine has support units for bracing between roof and floor. In this manner it is possible to measure and correspondingly monitor the travel of the heading machine made relative to such a support during penetration, and where necessary to support the progression hydraulically.

In order to be able to open different road widths without complex conversion work, the configuration is advantageously such that the length of the arm is greater than the radius of the disc-shaped tool holder. The length of the arm is advantageously dimensioned in such a manner that it takes account of the largest disc-shaped tool holder, which is used without this leading to a collision with the pivoting mechanism of the arm.

The configuration according to the invention is advantageously such that the arm is pivotally mounted in the horizontal direction, as a result of which it becomes possible to cut variable profiles and branches with the machine according to the invention, with the maneuverability of the heading machine being improved at the same time. In this embodiment the cutting tool is deflected out of the road centre to the left or right for the required cutting width, with the required advance of the drift taking place together with the movement of the disc tools in the vertical direction over the heading face.

The mounting of the arm for the horizontal and the vertical pivotability is preferably such that a horizontal pivoting mechanism is provided for the horizontal pivoting movement of the arm, which mechanism bears a vertical pivoting mechanism for the vertical pivoting movement of the arm. Such a deflection of the arm, which can be pivoted in the horizontal and vertical directions makes it possible to guide the arm in a horizontal plane away from the frame and from the other attachments of the heading machine, so that sufficient space is available for the vertical pivoting movement and collisions with other machine parts are avoided. Hereby, the configuration is advantageously such that on the horizontal pivoting mechanism, in particular on two lateral effect points of the horizontal pivoting mechanism, acts one hydraulic pivoting drive in each case, which allows the application of great forces in the horizontal direction in a constructively simple manner.

In order to allow the application of a sufficiently great force for the vertical pivoting of the arm and of the tool holder, the configuration is preferably devised such that the vertical pivoting mechanism has a hydraulic pivot drive, which is preferably formed by a plurality of hydraulic cylinder piston assemblies, which are arranged in parallel and act on the region of the arm, which carries the tool holder. On the upper side of the arm there is sufficient space to attach an appropriate number of cylinder piston assemblies, with the deflection at the region of the arm, which carries the tool holder creating favourable leverage ratios for the vertical pivoting movement.

In order to ensure increased flexibility of the positioning of the disc tools without having to move the whole heading machine, the configuration is advantageously devised such that the machine frame, which has the running gear, has a slide guide for a slide, which can be moved in the longitudinal direction of the machine, on which the arm is mounted pivotally in the vertical and, as the case may be, horizontal directions. With such a configuration, the heading machine can first move into a position adjacent to the heading face and if necessary be braced there in the road, whereupon the penetration process takes place by moving the slide, which bears the arm, forwards in the machine longitudinal direction. When the maximum displacement travel of the slide in the advance direction is reached, it is retracted and the whole heading machine is moved forward. Hereby, the configuration is advantageously devised such that the slide guide is formed by guide elements, in particular tubes or rods, which are arranged on both sides of the machine longitudinal centre plane, with it being possible for the guide elements to be connected to form a stable frame, which forms the machine frame by means of elements, which run transversely with respect to the machine longitudinal direction. The slide, which can be moved in the machine longitudinal direction, can be moved along the displacement direction, for example by means of spindle drives or hydraulic drives.

In order to be able to carry out corresponding walling work to secure the drift directly behind the heading face, the heading machine according to the invention is advantageously devised such that the slide has at least one anchor drilling and setting device, with the anchor drilling and setting device preferably being guided such that it can move in the longitudinal direction of the machine relative to the slide. By the anchor drilling and setting devices being fastened to the slide bearing also the arm, they are guided in correspondence with the displacement movement of the arm and of the tool holder and can be moved relative to the slide towards the heading face, in particular when the cutting process is interrupted, without it being necessary to retract the arm with the disc tools. After the necessary securing work has been carried out, the anchor drilling and setting devices can be retracted relative to the slide and operation of the disc tools on the arm can be resumed immediately. Hereby the configuration preferably is devised such that the anchor drilling and setting device is arranged above the horizontal pivoting mechanism on the slide so that the free displacement of the anchor drilling and setting device towards the heading face is ensured when the arm is lowered.

In particular when advancing a drift in hard rock, high pressing forces of the disc tools against the heading face are required so that under some circumstances displacement of the heading machine can occur. To prevent this, the configuration is preferably also developed in such a manner that the machine frame has a plurality of support devices, in particular hydraulic stays, which can be employed against the floor and roof in order to brace the machine between floor and roof. With such bracing by means of support devices, which can be employed against the floor and roof, the crawler track can under some circumstances be lifted completely off the ground and the machine can be borne just by the bracing forces. In this case the machine is securely mounted so that the necessary high forces can be applied to the rock material by means of the disc tools. Hereby, the heading machine is advantageously devised such that the support devices employed against the floor are formed by supporting feet, which are connected pivotably to the machine frame and are acted upon by hydraulic cylinder piston assemblies.

According to a preferred configuration of the present invention, the configuration is devised such that the support devices, which can be employed against the roof together bear a supporting frame, on which a roof cap, in particular a finger shield, is arranged in such a manner that it can be moved in the machine longitudinal direction. In this manner, securing of the roof, which has not yet been set with rock anchors, can take place when the machine is braced with the aid of the supporting devices, which can be employed against the floor and roof, with the operating personnel of the anchor drilling and setting devices being protected from any falling material.

In order to further improve the maneuverability of the heading machine according to the invention, the configuration is advantageously devised such that a conveying device is coupled such that it can be pivoted in the horizontal direction at the rear end of the machine. For the purpose of increased maneuverability, it can preferably likewise be envisaged that a power supply unit is coupled such that it can be pivoted in the horizontal direction at the rear end of the machine.

Figure 3:
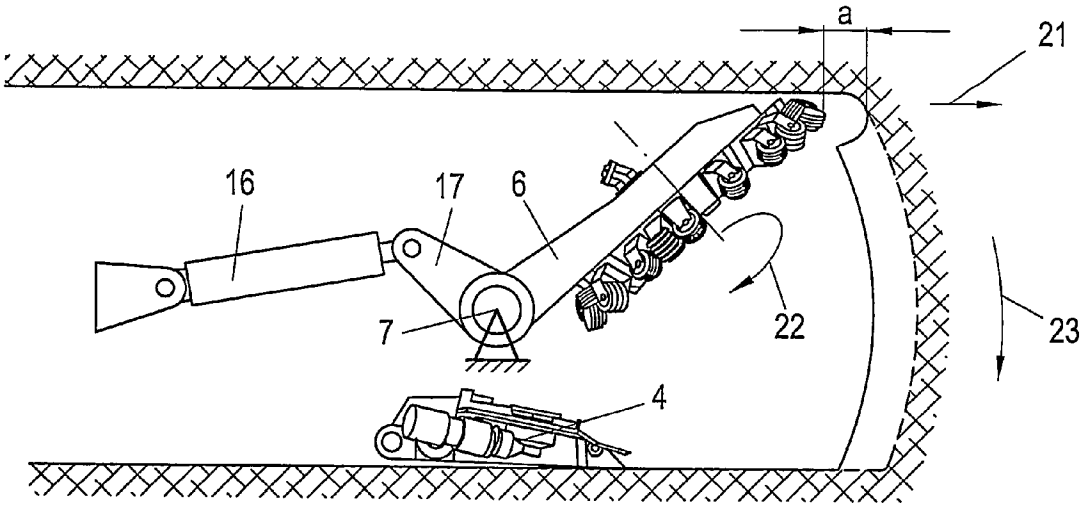
Figure 4:
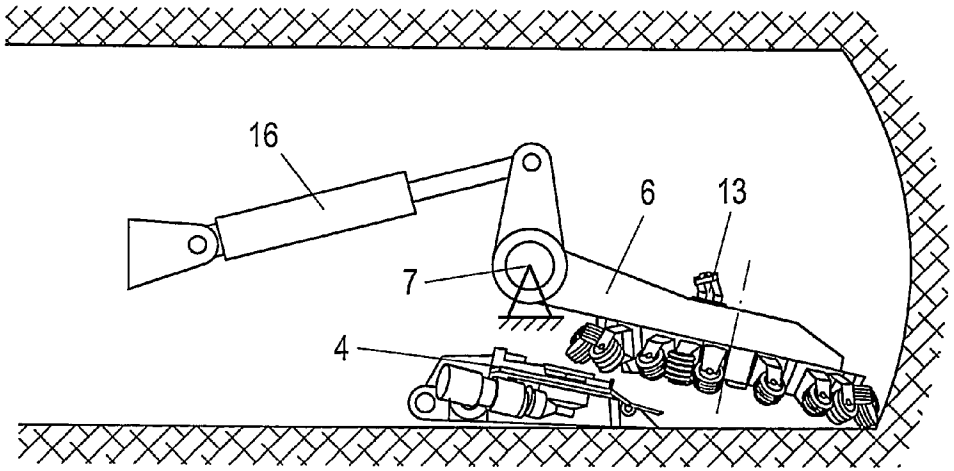
Figure 5:
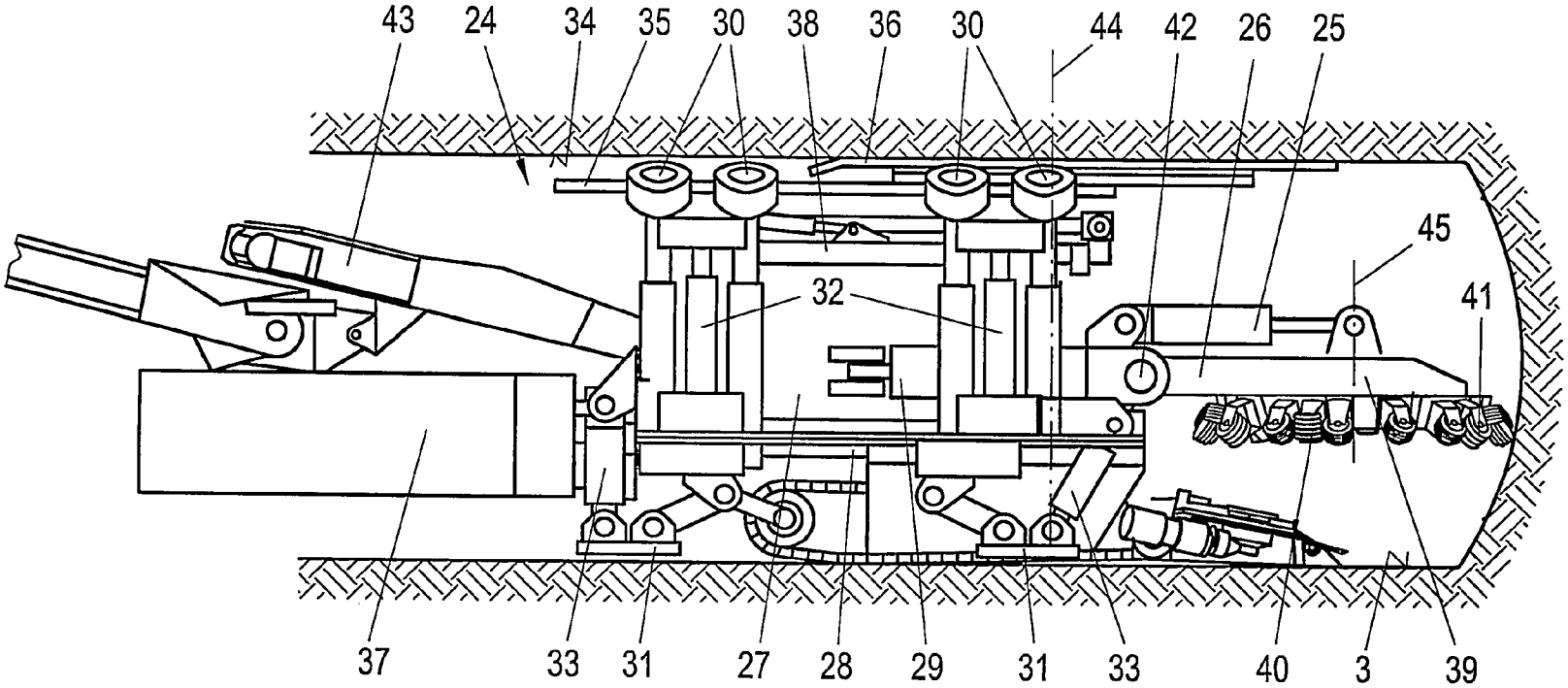
Figure 6:
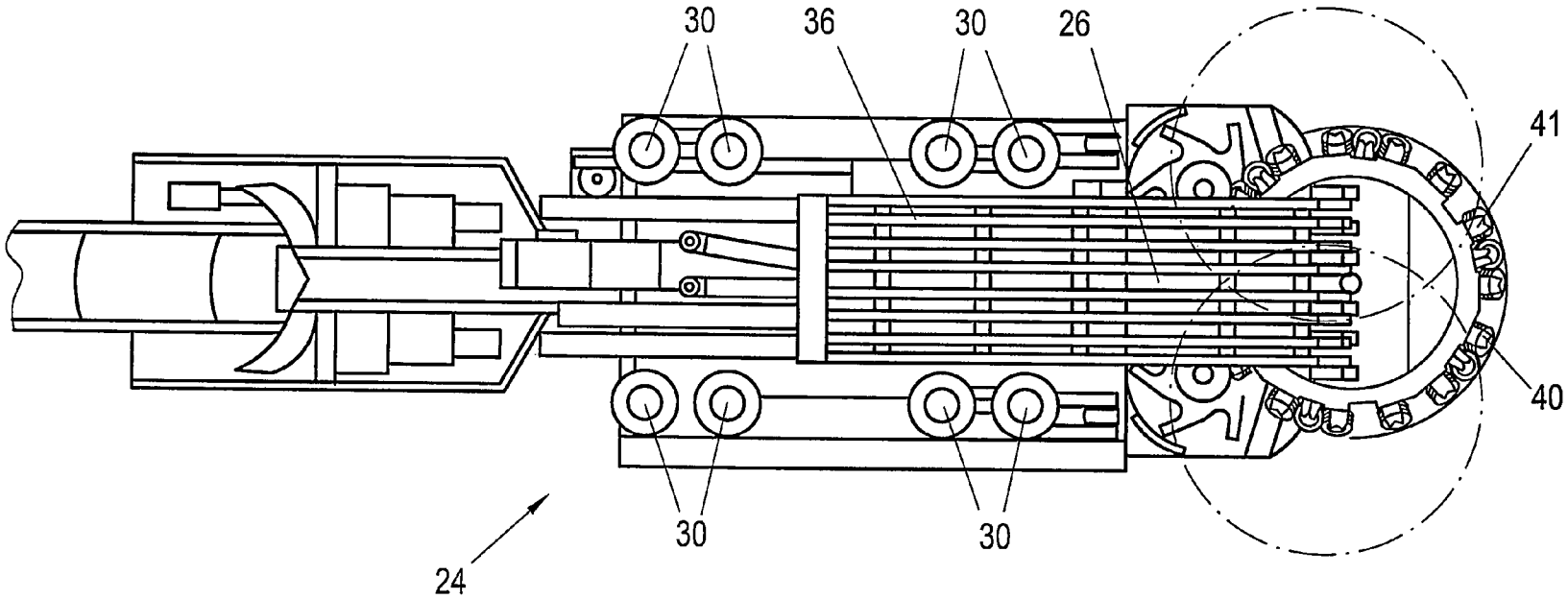
Figure 7:
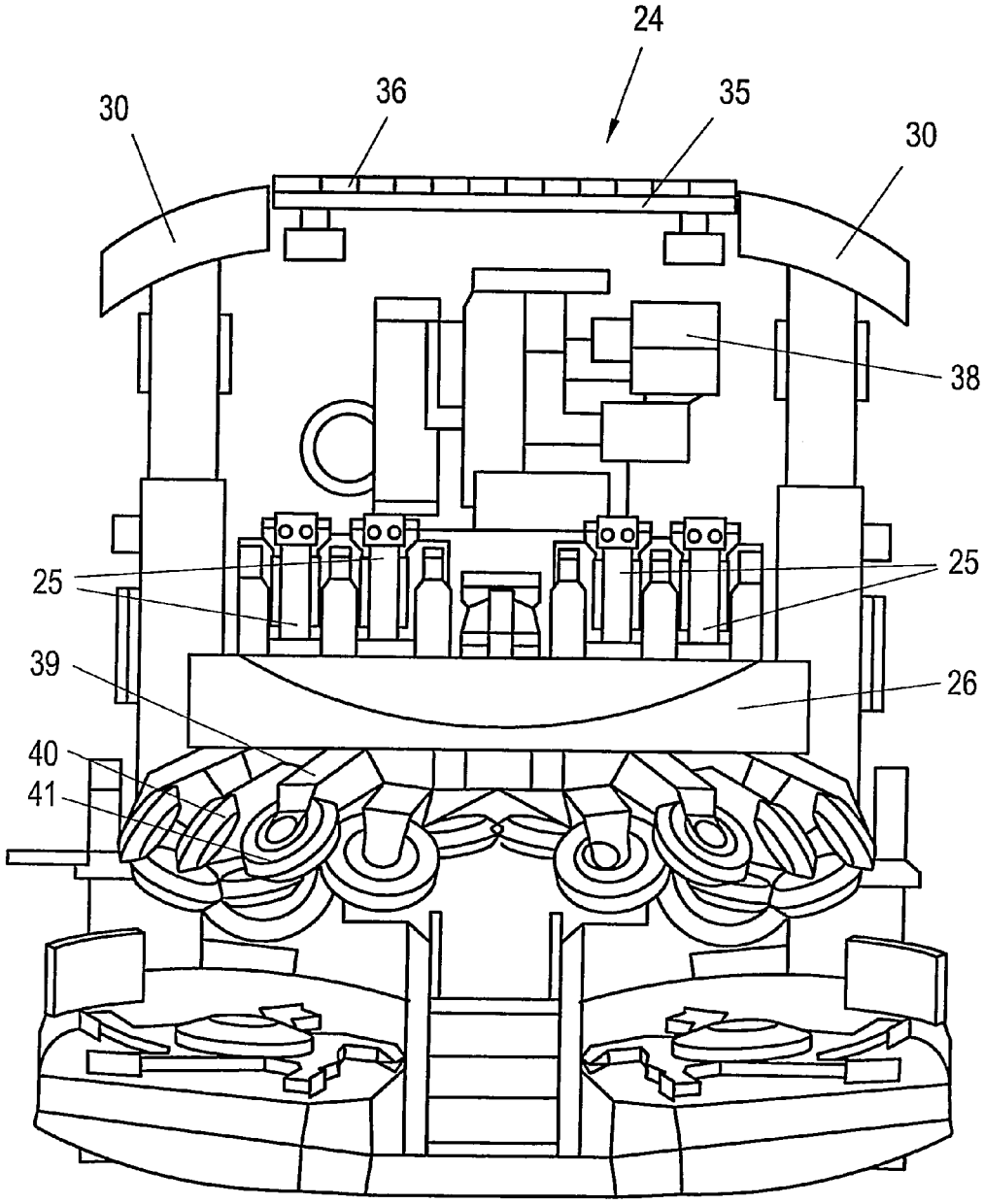
Figure 8:
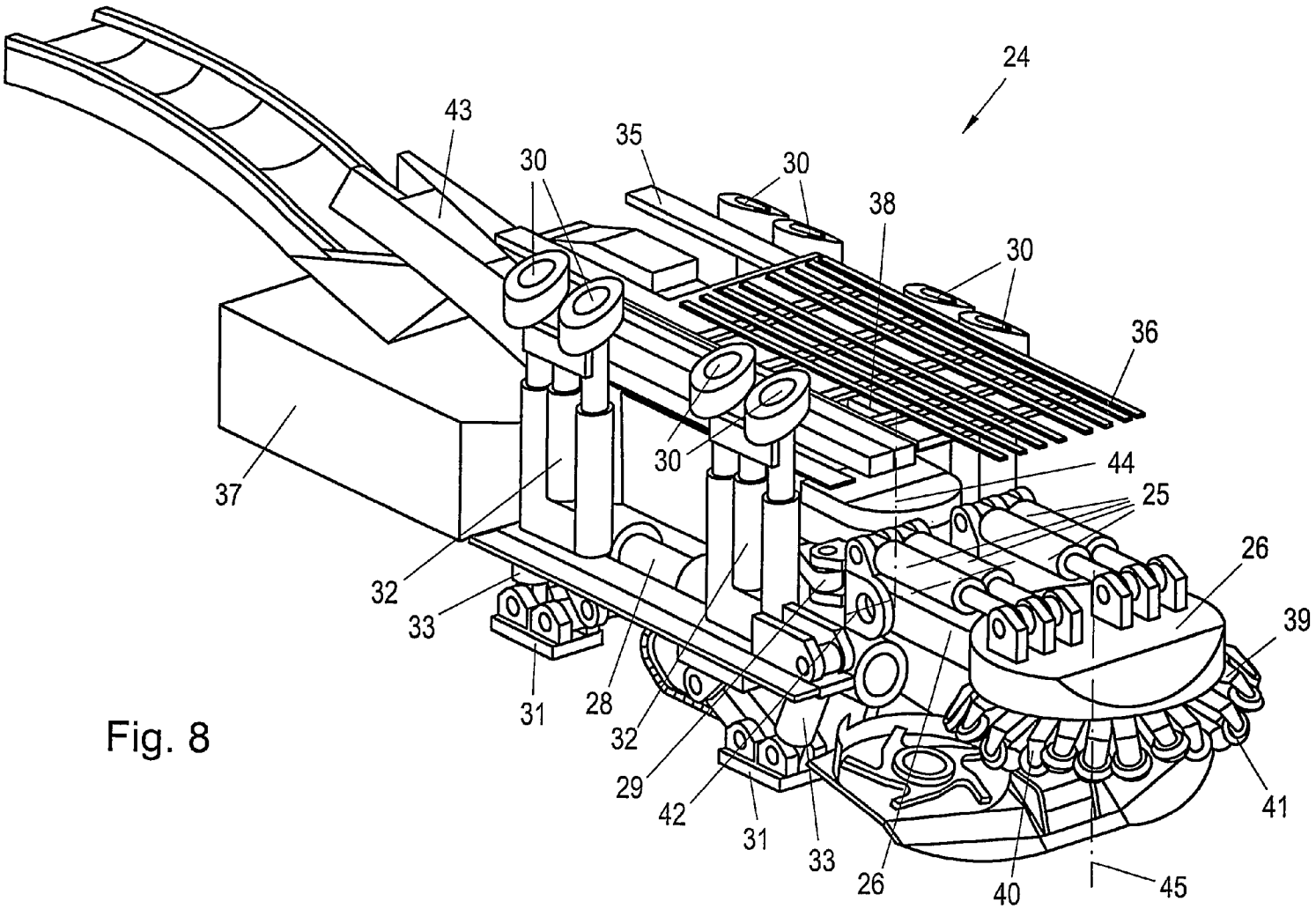

The invention is explained in more detail below using an exemplary embodiment, which is shown schematically in the drawing. In the drawing, FIG. 1 shows a side view of a heading machine according to the invention according to a first embodiment, FIG. 2 shows a plan view of the configuration of FIG. 1, FIG. 3 shows a detailed view of the cutting tool at the start of the advance and FIG. 4 shows a detailed view of the cutting tool in the position lowered towards the floor, FIG. 5 shows a side view of a further embodiment of the present invention, FIG. 6 shows a plan view of the configuration of FIG. 5, FIG. 7 shows a front view of the configuration of FIG. 5 and FIG. 8 shows a perspective representation of the configuration of FIG. 5.

FIG. 1 shows a heading machine 1, which can be moved by means of a crawler track 2 on the floor 3 of a road. The material cut in each case is taken by means of a loading device 4 to a conveyor 5 and thrown down onto the road conveying means. The heading machine 1 has an arm 6, which can be pivoted vertically in the direction of the double arrow 8 about an axis 7, which is essentially parallel to the plane of the floor 3. The rotational axis 9 of a tool holder 10 runs transversely with respect to the longitudinal extent of this arm 6 and transversely with respect to the axis 7, to which tool holder disc tools 11 and 12 are fastened on the circumference in different orientations. The motor 13 drives the tool holder 10 for rotation about the axis 9.

A cylinder piston assembly 14 can be seen for supporting and pressing the loading device against the floor. A roof cap 15 is provided for protecting and improving the support. The pivot drive for the arm 6 is formed by a hydraulic cylinder piston assembly 16, which acts on a lever arm 17 of the arm 6 and pivots it about the axis 7. In the rear region of the machine, a support 18 can be seen, with which a defined position can be fixed between roof and floor relative to the heading face, the lower support 19 can in this case contain a hydraulic cylinder piston assembly, which contains the progression device, which is schematically indicated with 20 and in this manner can support the progression during penetration while at the same time measuring the travel.

Figure 2:
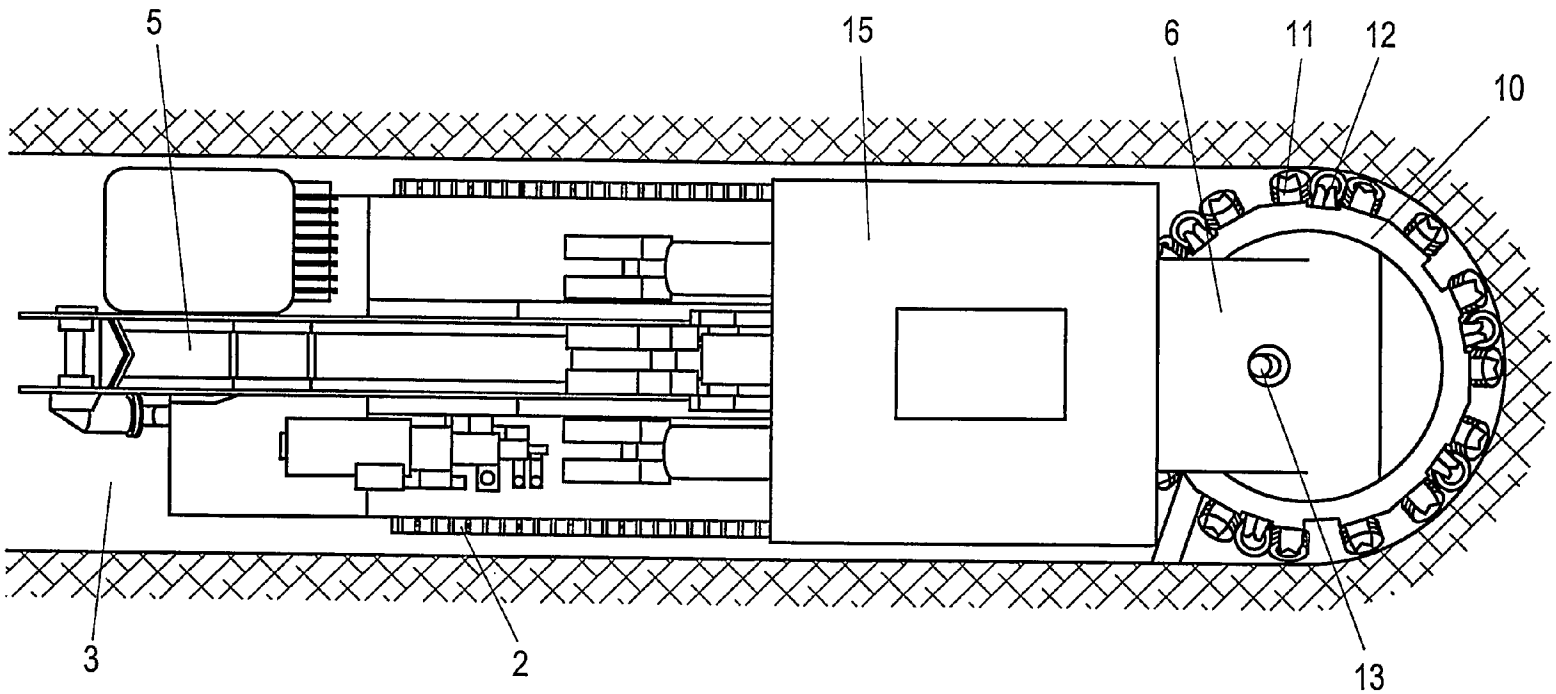

In FIG. 2 the reference symbols from FIG. 1 have been retained, with it being apparent at the same time that the diameter of the tool holder 10 with the disc tools 11 and 12 arranged on its circumference defines the width of the road. When the tool holder 10 with the disc tools 11 and 12 arranged on it is pivoted, the disc tools are in contact with the material to be removed from the heading face only over part of the circumference of the tool holder, with the material being partly cut and partly broken owing to the different orientation of the disc tools.

In the illustration according to FIG. 3 it can be seen how a particularly great penetration depth is achieved with the machine according to the invention. To this end, the arm 6 and the pivot cylinder 16, which actuates the arm 6 by means of the lever arm 17 is shown schematically, with the drive motor of the tool holder again being denoted by 13. The pivoting movement of the arm 6 to the roof brings the disc tools into a position, in which they can be moved in the direction of the arrow 21 into the heading face in order to achieve penetration when the machine is moved. After the desired penetration depth a has been achieved, the arm 6 with the tool holder, which rotates in the direction of the arrows 22 is then pivoted downwards, with this downward direction being denoted by 23. It is therefore possible during downward cutting to bring into contact with the material to be removed according to the undercutting principle preferably the discs, which are particularly suitable for this operation, with the taken up or cut material in turn being taken up by means of the loading device 4.

In FIG. 4, the lower position can be seen schematically, with it being clear above all that a collision with the loading device 4 can be reliably avoided even with large-dimensioned tool holders, and it likewise being apparent that the width of the face can be enlarged or varied merely by replacing the tool holder with a tool holder of a correspondingly larger diameter with the disc tools in turn distributed on the circumference.

FIG. 5 shows a further embodiment of the present invention, in which the heading machine is denoted by 24. 25 denotes cylinder piston assemblies, which bring about the vertical pivoting movement of the arm 26. A slide 27 is arranged on the frame of the heading machine 24 in such a manner that it can be displaced in the machine longitudinal direction, with the slide 27 being guided on rods or tubes 28. Cylinder piston assemblies 29 are arranged laterally of the longitudinal centre plane of the heading machine 24 on the slide 27 and on the arm 26 and allow a horizontal pivoting movement of the arm 26 about the axis 44. The heading machine 24 can be braced between the floor 3 and the roof 34 with the aid of hydraulic stays 30 and suitable support feet 31, which are controlled by means of corresponding cylinder piston assemblies 32 or 33. The hydraulic stays 30, which can be employed against the roof together bear a supporting frame 35, on which a roof cap 36 is arranged such that it can move in the machine longitudinal direction. 37 denotes a power supply unit and 43 denotes a conveying unit, which are in each case connected to the heading machine 24 such that they can pivot about a vertical axis. 45 denotes the rotational axis of the tool holder 39.

In FIG. 6, the reference symbols from FIG. 5 have been retained, with it being apparent that the horizontal pivotability of the arm 26 with the disc tools situated on it makes possible a cutting width, which exceeds the width of the heading machine 1. Furthermore it can be seen that the roof cap 36 is configured as a finger shield so that rock anchors can be set into the roof through the spaces left free between the individual battens of the finger shield.

In FIG. 7 it can be seen that anchor drilling and setting devices 38 are arranged below the finger shield 36, which rests on the supporting frame 35 and is raised and lowered together with the hydraulic stays 30. The tool holder 39 with the disc tools 40 and 41 arranged on it is fixed on the arm 26, which is raised and lowered by the cylinder piston assemblies 25, which are arranged in parallel.

The illustration according to FIG. 8 in turn shows the cylinder piston assemblies 25, which are arranged in parallel and pivot the arm 26 and the tool holder 39 fixed thereon about the axis 42.

The invention claimed is:

1. A heading machine, comprising:

a machine frame;

a running gear comprising a crawler track; and a cutting unit comprising an arm arranged on the machine frame, no more than one disc-shaped tool holder mounted rotatably on the arm, and disc tools held on the tool holder, wherein the arm is mounted pivotably in a vertical direction relative to the machine frame to pivot about an axis essentially parallel to a plane of a floor, by operation of a vertical pivoting mechanism that moves the arm in the vertical direction, the arm is mounted pivotably in a horizontal direction relative to the machine frame about an axis essentially perpendicular to the plane of the floor, by operation of a horizontal pivoting mechanism that moves the arm in the horizontal direction, the tool holder rotates around a rotational axis that runs transversely to a longitudinal axis of the arm, and runs transversely to the axis of the vertical pivot of the arm relative to the machine frame, said tool holder being arranged to allow the disc tools to be brought into contact with material to be removed over part of a circumference of the tool holder, and a plurality of discs or disc bundles respectively are formed inclined in direction towards the rotational axis of the tool holder.

2. The heading machine according to claim 1, wherein the rotational axis (9) of the tool holder (10, 39) forms an angle of 45° to 135° with the longitudinal axis of the arm (6, 26).

3. The heading machine according to claim 1, wherein the discs (11, 41) or disc bundles are arranged on the circumference of the tool holder (10, 39) with a different orientation or cutting direction than other discs (12, 40).

4. The heading machine according to claim 1, wherein the plurality of discs (11, 12, 40, 41) or disc bundles are arranged in a direction inclined to the floor (3).

5. The heading machine according to claim 1, wherein the heading machine (1, 24) has support units (18, 19, 30, 31) for bracing between a roof and the floor (3).

6. The heading machine according to claim 1, wherein a length of the arm (6, 26) is greater than a radius of the disc-shaped tool holder (10, 39).

7. The heading machine according to claim 1, wherein the horizontal pivoting mechanism bears the vertical pivoting mechanism.

8. The heading machine according to claim 7, wherein, on the horizontal pivoting mechanism, a hydraulic pivot drive (29) acts on each of two lateral effect points of the horizontal pivoting mechanism.

9. The heading machine according to claim 7, wherein the vertical pivoting mechanism has a hydraulic pivot drive formed from a plurality of hydraulic cylinder piston assemblies (25), which are arranged in parallel and act on a region of the arm (6, 26) that carries the tool holder (10, 39).

10. The heading machine according to claim 7, wherein the machine frame has a slide guide for a slide (27), said slide (27) being movable in a longitudinal direction of the heading machine, on which slide the arm (6, 26) is mounted pivotally to move in at least one of the vertical direction and the horizontal direction, and an anchor drilling and setting device (38) is arranged on the slide (27) above the horizontal pivoting mechanism.

11. The heading machine according to claim 1, wherein the machine frame has a slide guide for a slide (27), said slide (27) being movable in a longitudinal direction of the heading machine, on which slide the arm (6, 26) is mounted pivotally to move in at least one of the vertical direction and the horizontal direction.

12. The heading machine according to claim 11, wherein the slide guide is formed by guide elements arranged on both sides of a longitudinal center plane of the heading machine.

13. The heading machine according to claim 11, wherein the slide (27) has at least one anchor drilling and setting device (38).

14. The heading machine according to claim 13, wherein the anchor drilling and setting device (38) is guided to be movable in the longitudinal direction of the machine relative to the slide (27).

15. The heading machine according to claim 1, wherein the machine frame has a plurality of support devices positioned to engage against the floor (3) and a roof to brace the machine between the floor (3) and the roof.

16. The heading machine according to claim 15, wherein the support devices positioned to engage against the floor are formed by supporting feet (31) connected pivotably to the machine frame and acted upon by hydraulic cylinder piston assemblies (33).

17. The heading machine according to claim 15, wherein the support devices (30) positioned to engage against the roof together bear a support frame (35), and a roof cap (15, 36) is movably arranged on the support frame (35) to move in a longitudinal direction of the machine.

18. The heading machine according to claim 1, further comprising a conveying device (5, 43) coupled to be pivotable in a horizontal direction at a rear end of the machine.

19. The heading machine according to claim 1, further comprising a power supply unit (37) coupled to be pivotable in a horizontal direction at a rear end of the machine.

* * * * *